US005803158A

United States Patent [19]

Harder et al.

[11] Patent Number: 5,803,158

[45] Date of Patent: Sep. 8, 1998

[54] AIR PREHEATER HEAT TRANSFER SURFACE

[75] Inventors: William F. Harder; Robin B. Rhodes, both of Wellsville, N.Y.

[73] Assignee: ABB Air Preheater, Inc., Wellsville, N.Y.

[21] Appl. No.: 725,964

[22] Filed: Oct. 4, 1996

[51] Int. Cl.[6] ..... F28D 17/00

[52] U.S. Cl. ..... 165/10; 165/8; 165/6

[58] Field of Search ..... 165/10, 8, 6, 4

[56] References Cited

U.S. PATENT DOCUMENTS

| | | | |
|---|---|---|---|
| 2,438,851 | 3/1948 | Gates | 165/10 |
| 2,596,642 | 5/1952 | Boestad | 165/8 |
| 2,802,646 | 8/1957 | Jetter | 165/8 |
| 2,940,736 | 6/1960 | Ödman | 165/10 |
| 2,983,486 | 5/1961 | Rosenberg | 165/8 |
| 3,369,592 | 2/1968 | Dedow | 165/8 |
| 4,125,149 | 11/1978 | Kritzler et al. | 165/10 |
| 4,345,640 | 8/1982 | Cullinan | 165/10 |
| 4,396,058 | 8/1983 | Kurschner et al. | 165/8 |
| 4,449,573 | 5/1984 | Pettersson et al. | 165/10 |
| 4,553,458 | 11/1985 | Schoonover | 83/33 |
| 4,633,936 | 1/1987 | Nilsson | 165/8 |
| 4,744,410 | 5/1988 | Groves | 165/10 |
| 4,903,756 | 2/1990 | Monro | 165/8 |
| 4,953,629 | 9/1990 | Karlsson et al. | 165/10 |
| 5,318,102 | 6/1994 | Spokoyny et al. | 165/10 |
| 5,323,842 | 6/1994 | Spokoyny et al. | 165/8 X |

FOREIGN PATENT DOCUMENTS

| | | | |
|---|---|---|---|
| 668476 | 3/1952 | United Kingdom . | |
| 0717601 | 10/1954 | United Kingdom | 165/10 |
| 1055406 | 1/1967 | United Kingdom | 165/8 |

*Primary Examiner*—Ira S. Lazarus
*Assistant Examiner*—Christopher Atkinson
*Attorney, Agent, or Firm*—Alix, Yale & Ristas, LLP

[57] ABSTRACT

An air preheater has heat transfer elements with a first series of corrugated elements having longitudinally oriented, mutually parallel corrugations formed generally continuously across the lateral direction. Positioned on either side of each of the corrugated elements of the first series are a series of notched plates each having mutually parallel spaced apart notches. Each notch is formed by parallel double ridges projecting transversely from opposite sides and the element has flat sections between the notches. The notches are oriented obliquely in mutually opposite directions relative to the corrugations of the adjacent elements whereby the notched elements are in contact with the corrugated elements solely at the points of intersection of the notches and corrugations. This produces an increased number of boundary layer breaks and improves heat transfer as well as providing straight line passages through the elements.

1 Claim, 5 Drawing Sheets

AIR PREHEATER HEAT TRANSFER SURFACE

BACKGROUND OF THE INVENTION

The present invention relates to rotary regenerative air preheaters for the transfer of heat from a flue gas stream to a combustion air stream. More particularly, the present invention relates to a heat transfer surface of an air preheater.

Rotary regenerative air preheaters are commonly used to transfer heat from the flue gases exiting a furnace to the incoming combustion air. Conventional rotary regenerative air preheaters have a rotor rotatably mounted in a housing. The rotor supports heat transfer surfaces defined by heat transfer elements for the transfer of heat from the flue gases to the combustion air. The rotor has radial partitions or diaphragms defining compartments therebetween for supporting the heat transfer elements. Sector plates extend across the upper and lower faces of the rotor to divide the preheater into a gas sector and an air sector. The hot flue gas stream is directed through the gas sector of the preheater and transfers heat to the heat transfer elements on the continuously rotating rotor. The heat transfer elements are then rotated to the air sector of the preheater. The combustion air stream directed over the heat transfer elements is thereby heated.

Heat transfer elements for regenerative air preheaters have several requirements. Most importantly, the heat transfer element must provide the required quantity of heat transfer or energy recovery for a given depth of the heat transfer element. Conventional heat transfer elements for preheaters use combinations of flat or form-pressed steel sheets or plates with ribbing. When stacked in combination, the plates form passages for the movement of the flue gas stream and air stream through the rotor of the preheater. The surface design and arrangement of the heat transfer plates provides contact between adjacent plates to define and maintain the flow passages through the heat transfer element. Further requirements for the heat transfer elements are that the elements produce minimal pressure drop for a given depth of the heat transfer elements, and furthermore, fit within a small volume.

Heat transfer elements are subject to fouling from particulates and condensed contaminants, typically referred to as soot, in the flue gas stream. Therefore, another important performance consideration is low susceptibility of the heat transfer element to significant fouling. Furthermore, the heat transfer element should be easily cleanable when fouled. Fouling of the heat transfer elements is conventionally removed by soot blowing equipment emitting pressurized dry steam or air to remove particulates, scale and contaminants from the heat transfer elements by impact energy. The heat transfer elements therefore must allow soot blower energy to penetrate through the first layer of heat transfer elements with sufficient energy to clean heat transfer elements positioned more remotely from the soot blowing equipment. In addition, the heat transfer elements must also survive the wear and fatigue associated with soot blowing.

A further design consideration for heat transfer elements is the ability to have a line of sight through the depth of the heat transfer element. The line of sight allows infrared or other hot spot detection systems to sense hot spots or early stages of fires on the heat transfer elements. Rapid and accurate detecting of the hot spots and fires minimizes damage to the preheater.

Conventional preheaters typically employ multiple layers of different types of heat transfer elements on the rotor. The rotor has a cold end layer positioned at the flue gas outlet, an intermediate layer and a hot end layer positioned at the flue gas inlet. Typically the hot end layer employs high heat transfer elements which are designed to provide the highest relative energy recovery for a given depth of heat transfer element. These high heat transfer elements conventionally have obliquely oriented and interconnected flow channels which provide the high heat transfer but which allow the energy from the soot blowing stream to spread or diverge as it travels into and through the heat transfer elements. The divergence of the soot blower stream greatly reduces cleaning efficiency of the heat transfer elements closest to the soot blower, and also more remotely positioned heat transfer element layers.

The most significant amounts of fouling typically occur in the cold end layer due at least in part to condensation. The obliquely oriented flow channels of conventional high heat transfer elements generally preclude their use in the cold end layer due to the soot blowing energy being significantly dissipated during penetration of such high heat transfer elements. Therefore, in order to provide heat transfer surfaces that allow for efficient and effective cleaning by soot blowing, straight channel elements are employed at least in the cold end layer in order to decrease soot blowing energy dissipation. Therefore, the heat transfer or energy recovery efficiency has typically been compromised and a greater depth of straight channel heat transfer elements are required to provide equivalent heat transfer capacity compared to conventional high heat transfer elements.

SUMMARY OF THE INVENTION

Briefly stated, the invention is a heat transfer element for the transfer of heat from a flue gas stream to an air stream in a rotary regenerative air preheater. The heat transfer element has a corrugated heat transfer plate having longitudinally oriented, mutually parallel corrugations. The corrugations are formed generally continuously across the entire lateral direction of the first heat transfer plate.

Positioned on either side of the corrugated heat transfer plate are notched plates each having mutually parallel spaced apart notches. Each notch is formed by parallel double ridges projecting transversely from opposite sides of the notched heat transfer plate. The notched heat transfer plates further define flat sections between the notches. The notches of the notched heat transfer plates are further oriented obliquely in mutual opposite directions relative to the corrugations on the corrugated heat transfer plate. Each of the notched heat transfer plates is in contact with the corrugated heat transfer plate solely at points of intersection of the notches and the corrugations.

The heat transfer element in accordance with the invention has an increased number of contact points between the corrugated and notched heat transfer plates relative to prior heat transfer elements having merely stacked notched heat transfer plates. The increased number of contact points between the corrugated and notched heat transfer plates results in an increased number of boundary layer breaks. These boundary layer breaks disrupt heat boundary layers that can occur along the surfaces of the heat transfer plates and degrade heat transfer performance. The increased number of boundary layer breaks therefore lead to increased and improved heat transfer between the fluid medium and the heat transfer element of the invention.

The corrugated heat transfer plate provides generally continuous straight line passages through the heat transfer element. Therefore, during a soot blowing operation, the corrugated heat transfer plate permits the blowing medium to penetrate the entire depth of the heat transfer element for improved soot blowing. The stacked arrangement of the corrugated and notched heat transfer plates further allows a line of sight view through the entire depth of the heat transfer element. Consequently, infrared sensors can detect hot spots and the early stages of element fires on the heat transfer element for efficient operation and fire prevention of the preheater.

DESCRIPTION OF THE PREFERRED EMBODIMENT

Figure 1:
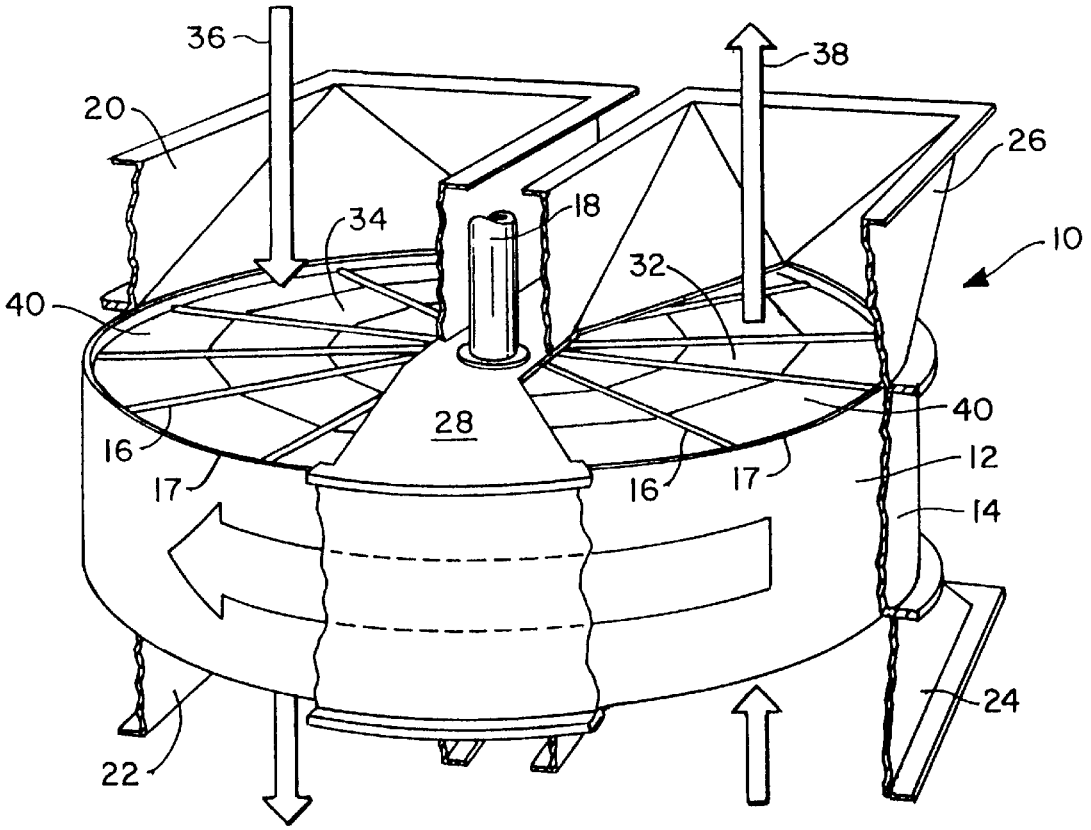
FIG. 1 is a partially broken away perspective view of a rotary regenerative preheater.

With reference to FIG. 1 of the drawings, a conventional rotary regenerative preheater is generally designated by the numerical identifier 10. The air preheater 10 has a rotor 12 rotatably mounted in a housing 14. The rotor 12 is formed of diaphragms or partitions 16 extending radially from a rotor post 18 to the outer periphery of the rotor 12. The partitions 16 define compartments 17 therebetween for containing heat exchange elements 40.

The housing 14 defines a flue gas inlet duct 20 and a flue gas outlet duct 22 for the flow of heated flue gases through the air preheater 10. The housing 14 further defines an air inlet duct 24 and an air outlet duct 26 for the flow of combustion air through the preheater 10. Sector plates 28 extend across the housing 14 adjacent the upper and lower faces of the rotor 12. The sector plates 28 divide the air preheater 10 into an air sector 32 and a flue gas sector 34. The arrows of FIG. 1 indicate the direction of a flue gas stream 36 and an air stream 38 through the rotor 12. The hot flue gas stream 36 entering through the flue gas inlet duct 20 transfers heat to the heat transfer elements 40 mounted in the compartments 17. The heated heat transfer elements 40 are then rotated to the air sector 32 of the air preheater 10. The stored heat of the heat transfer elements 40 is then transferred to the combustion air stream 38 entering through the air inlet duct 24. The cold flue gas stream 36 exits the preheater 10 through the flue gas outlet duct 22, and the heated air stream 38 exits the preheater 10 through the air outlet duct 26.

Figure 2:
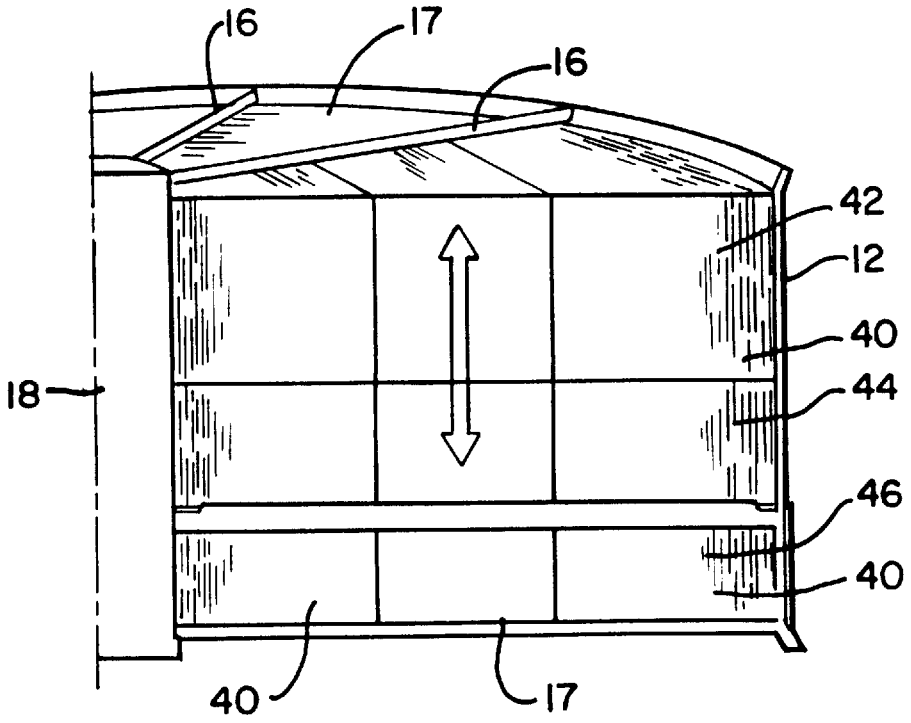
FIG. 2 is a fragmentary, cross-sectional view of the rotor of FIG. 1.
Figure 3:
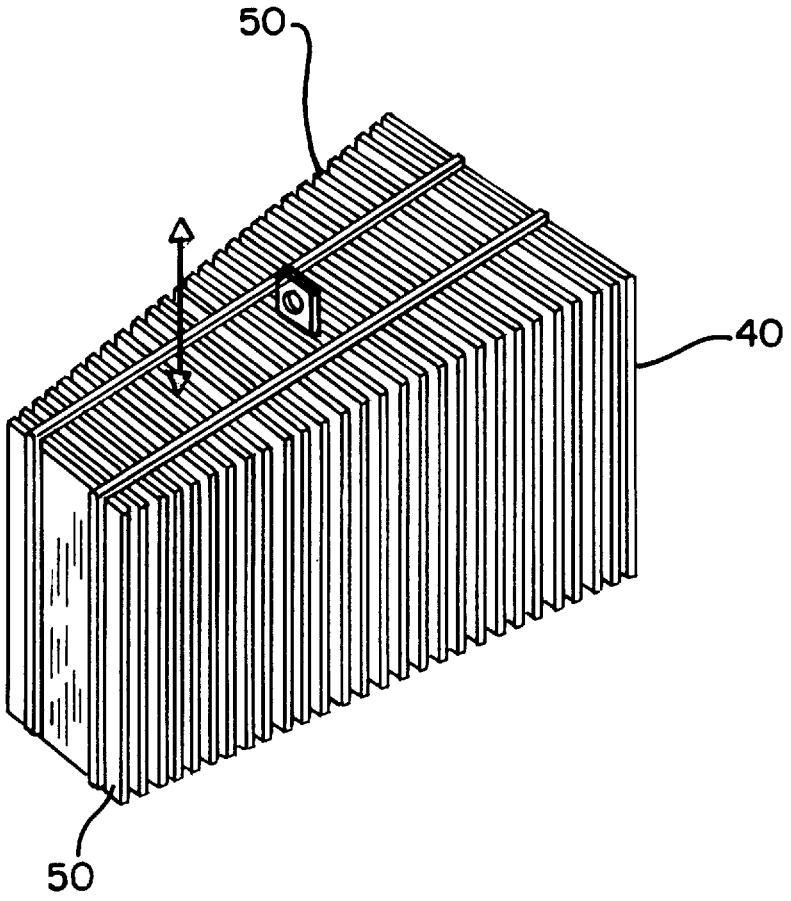
FIG. 3 is a perspective view of a heat transfer element of FIG. 2 in accordance with the invention.

The rotor 12 has generally three layers of heat transfer elements 40. (See FIGS. 2 and 3) A hot end layer 42 is positioned closest to the flue gas inlet duct 20 and the air outlet duct 26. An intermediate layer 44 is positioned adjacent the hot end layer, and finally a cold end layer 46 is positioned generally adjacent the flue gas outlet duct 22 and air inlet duct 24.

The heat transfer elements 40 are constructed as a stack of alternating corrugated heat transfer plates 50 and notched heat transfer plates 52. The corrugated heat transfer plates 50 define longitudinally oriented, mutually parallel corrugations 51. The corrugations 51 are generally parallel with the main flow direction of the fluid medium through the heat transfer element 40. The corrugations 51 are preferably formed continuously across the entire lateral direction of the corrugated heat transfer plate 50.

Positioned on either side of the corrugated heat transfer plate 50 are notched heat transfer plates 52. Each notched heat transfer plate 52 defines mutually parallel notches 54. The notches 54 are formed of mutually parallel double ridges 56 projecting transversely from opposite sides of the notched heat transfer plate 52. The notches 54 preferably define an S-shaped cross section. However, the notches 54 can also have a more triangular or Z-shaped cross section, or have other well known shapes of notches to form oppositely transversely extending multiple ridges. The notched heat transfer plate 52 defines flat sections 58 between the notches 54. The heat transfer plates 52 positioned on opposite sides of the corrugated heat transfer plate 50 are oriented obliquely in mutual opposite directions relative to the orientation of the corrugations 51 on the corrugated heat transfer plate 50. As a result, the notched heat transfer plates 52 and corrugated heat transfer plate 50 are in contact solely at the intersection of the corrugations 51 and the ridges 56 of the notches 54.

The corrugations 51 of the corrugated heat transfer plate 50 define line of sight views through the heat transfer element 40, therefore allowing the monitoring of hot spots and the early phases of heat transfer element fires by an infrared or other sensing system. The corrugations 51 of the corrugated heat transfer plate 50 further provide straight line passages for penetration of the cleaning medium of the soot blowing apparatus into the interior of the heat transfer element 40 to remove deposits from the heat transfer element 40.

Figure 4:
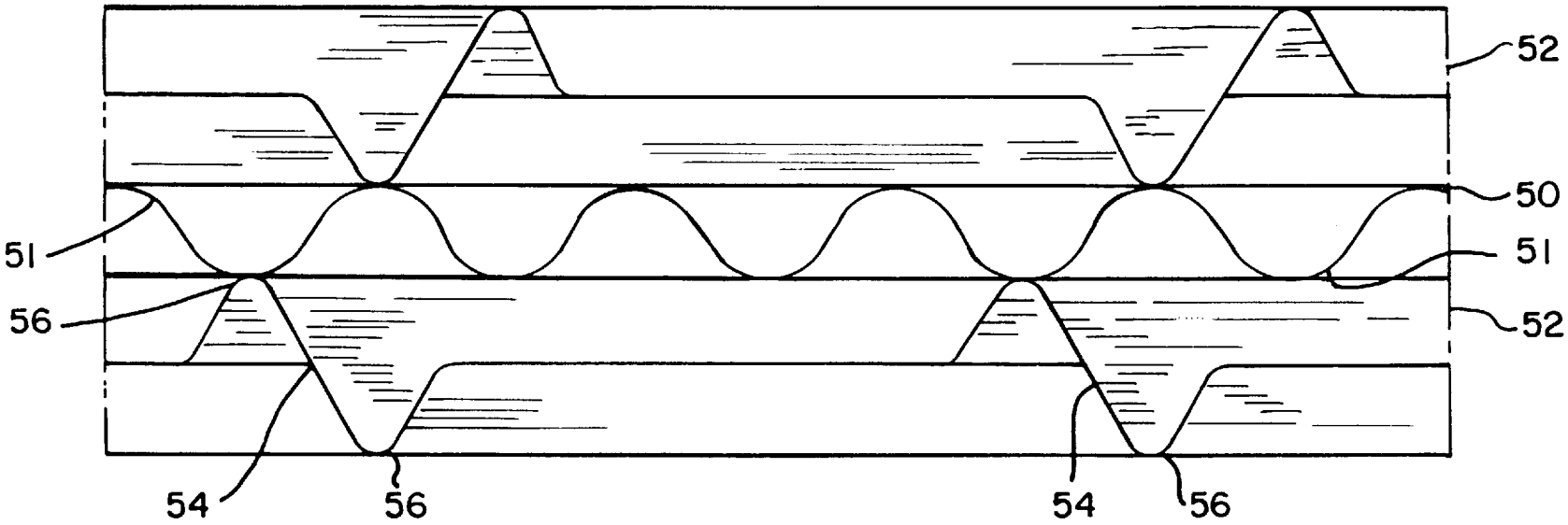
FIG. 4 is a fragmentary end-on-view of the heat transfer element of FIG. 3.
Figure 5:
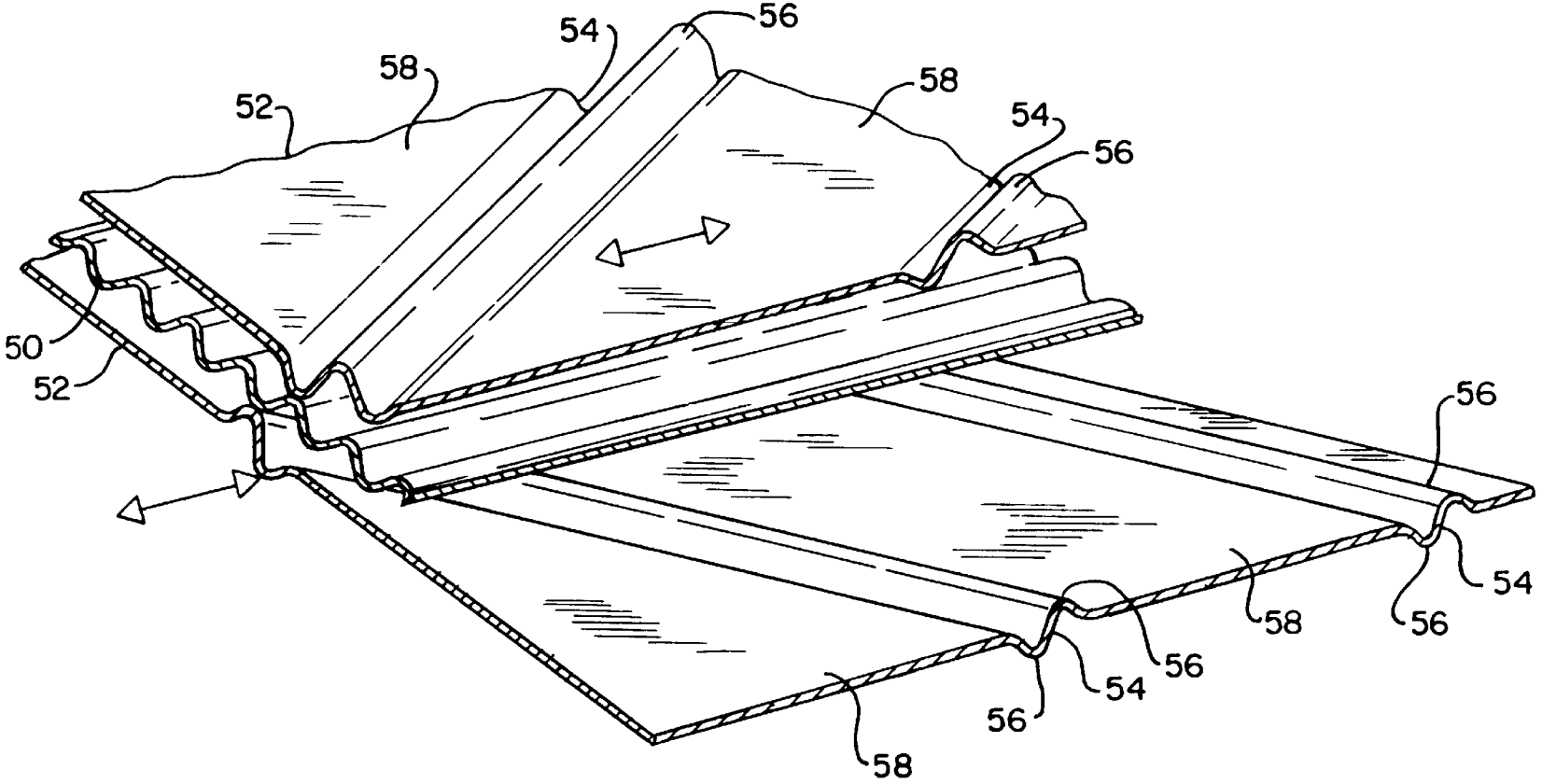
FIG. 5 is a fragmentary partial cross-sectional, perspective view of the heat transfer element of FIG. 3.

The intersections or contact points of the ridges 56 and corrugations 54, (See FIG. 4) provide boundary trips in the thermal boundary that occurs between the fluid medium flowing and the surfaces of the heat transfer element 40. The increased number of contact points between the heat transfer plates 50, 52 relative to a conventional heat transfer plates provides for improved heat transfer performance between the fluid medium and the heat transfer element 40 in accordance with the invention.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

We claim:

1. A heat transfer element for an air preheater comprising:

an alternating arrangement of adjacent corrugated and notched heat transfer plates, said corrugated plates having longitudinally oriented mutually parallel corrugations formed generally continuously across the lateral direction of said corrugated plate, and said notched plates having straight notches formed from mutually parallel double ridges projecting transversely from opposite sides of said notched plate, and flat sections between said notches, each said notched plate in contact with the adjacent said corrugated plates solely at points of intersection of said notches and said corrugations, and said double ridges of said adjacent notched plates oriented obliquely in mutual opposite directions to said corrugations.

* * * * *